United States Patent [19]

Waters et al.

[11] Patent Number: 4,647,360

[45] Date of Patent: Mar. 3, 1987

[54] INERT CARBON FIBER DIAPHRAGM

[75] Inventors: Donald D. Waters, Lake Jackson; Thomas K. Fletcher, Angleton; Stephen P. Krupp, Lake Jackson, all of Tex.

[73] Assignee: The Dow Chemical Company, Midland, Mich.

[21] Appl. No.: 784,393

[22] Filed: Oct. 4, 1985

[51] Int. Cl.[4] ..... C25B 13/08

[52] U.S. Cl. ..... 204/296; 162/138; 162/164.1; 264/29.2; 264/105

[58] Field of Search ..... 204/98, 128, 252, 296; 264/29.2, 105; 162/138, 164.1

[56] References Cited

U.S. PATENT DOCUMENTS

| | | | |
|---|---|---|---|
| 3,989,615 | 11/1976 | Kiga et al. | 204/296 |
| 4,186,076 | 1/1980 | de Nora et al. | 204/296 |
| 4,216,073 | 8/1980 | Goldstein | 204/296 |
| 4,396,663 | 8/1983 | Mitchell | 264/29.2 |
| 4,434,206 | 2/1984 | Fukuda et al. | 264/29.2 |
| 4,486,276 | 12/1984 | Cohn et al. | 204/128 |
| 4,505,797 | 3/1985 | Hodgdon et al. | 204/296 |

FOREIGN PATENT DOCUMENTS

| | | | |
|---|---|---|---|
| 0033262 | 8/1981 | European Pat. Off. | 204/296 |
| 2136829 | 9/1984 | United Kingdom | 204/296 |

*Primary Examiner*—Terryence Chapman

*Attorney, Agent, or Firm*—James H. Dickerson, Jr.

[57] ABSTRACT

A diaphragm or membrane for use in electrolysis cells resistant to chemical action thereof is disclosed. In the preferred and illustrated embodiment, a fluoropolymer binder cooperative with a random mix of carbon fibers up to about 13 mm long and up to about 0.01 mm in diameter forms such diaphragm or membrane. The carbon fibers are preferably pliable, nonbrittle, resilient, electrically nonconductive, impervious to chemical attack, and are annealed up to a specified temperature.

12 Claims, No Drawings

INERT CARBON FIBER DIAPHRAGM

BACKGROUND OF THE DISCLOSURE

This disclosure is directed to a diaphragm or membrane adapted to be placed in an alkali metal halide electrolysis cell. A classic example of this type of cell is the chlor-alkali cell. Briefly, the membrane defines adjacent anode and cathode chambers. Brine is introduced into the anode chamber and allowed to fill the cathode chamber by flowing through the diaphragm, thus completely wetting the diaphragm and flushing out all of the entrained air. An electric current flowing between anode and cathode in the two chambers creates ionic movement between the two chambers passing through the membrane. The process typically forms caustic and hydrogen discharge gas from the cathode side and chlorine gas on the anode side. The membrane is thus exposed to strong corrosive chemicals typically being caustic on one side and chlorine on the other. This occurs in the context of elevated temperatures and relatively substantial electric current densities across the membrane.

The traditionally used membranes are formed of asbestos fibers. A less popular membrane is one made of various fluoropolymers. An example is the fluoropolymer membrane manufactured by DuPont and sold under the trademark NAFION. There is probably a preponderance of membranes formed of asbestos. Asbestos is a material which is difficult to discard when the membrane is depleted or otherwise worn. Asbestos is an extremely difficult material to handle properly with environmental safety. It has the virtue of being operative at relatively high temperatures. It appears that the temperatures that asbestos can tolerate exceed those of NAFION membranes. As the temperature of the electrolytic cell is raised, the operating conditions become much more severe and the rate of wear or depletion is accelerated. Once an asbestos membrane has become depleted in operation, repair is unlikely and it simply must be discarded and replaced with a new membrane.

By contrast, the membrane in accordance with the teaching of this disclosure is one which can be used to depletion and thereafter recycled. That is, the membrane can be recycled as for instance by melting the binding resin. Alternatively, after grinding, the particles or fibers can be used as filler in plastic filled molded items. Another alternative is to recycle the spent membrane by combustion. Any of these approaches is sufficient to avoid simply placing the used membrane in some trash container. They avoid environmental difficulties arising from discarding asbestos membranes. Moreover, the membrane of this disclosure is adapted to operate at relatively high temperatures and in rigorous conditions where it is impervious to caustic or acids formed by or used in an electrolysis cell. Thermal stability appears to be higher than that of asbestos. Moreover, membranes formed by the disclosed process appear to have current efficiencies comparable with asbestos membranes. A significant amount of electrical power is required for a chlor-alkali cell as an example. The power consumption of a cell is indicated by the simple relationship of voltage drop times total cell current. The current is typically measured in ASI (amperes per square inch) or perhaps in amperes per square centimeter. A significant amount of power is applied to a cell and generates heat in an amount given by VI, referring to cell voltage drop and current. It is not uncommon to have a membrane which is several thousand square inches. With a cell voltage in the range of about two to three volts, and with a current density upwards of about 0.3 to even as high as 1.0 ASI, each square inch of the membrane contributes about 1 to 1.5 watts power to be dissipated by the cell. Clearly, with a membrane which is 20 feet long (240 inches or 6096 centimeters), the amount of heat liberated in the cell is quite high. The spot temperature at or adjacent to the membrane in the cell can climb quite high.

The membrane which is formed by the procedure of the present disclosure is able to handle such high temperatures with a marked degree of thermal stability. Two recent patents by deNora are perhaps representative of other attempts to solve the problem of avoiding an asbestos fiber membrane. U.S. Pat. Nos. 4,186,076 and 4,236,979 describe a fiberous porous matrix of various vinyls in conjuction with woven or unwoven carbon fiber felts. In similar fashion, U.S. Pat. No. 4,432,860 mentions fluoropolymers reinforced with carbon fibers. It appears that the references mentioned above and representative of the prior art do not disclose the procedure which is set forth below in detail. Briefly, a felt of carbon fibers having a specified range of lengths, and also having a range of diameters, is mixed with fluoropolymers of a specified formulation. The binder typically ranges from one to about 20 percent of membrane weight fluoropolymers, the optimum being about 10 to 15 percent. Utilizing a vacuum depositing procedure, the felt of fluoropolymers and carbon fibers is then dried and heated to the sinter point of the fluoropolymer whereupon the felt is formed. An optimum weight is in the range of about 0.4 to about 0.5 gm/in$^2$ or about 0.1 gm/cm$^2$. This yields a membrane which can handle current densities about up to 1.0 ASI. Moreover, it yields a membrane which is substantially nonconductive and yet which has a substantial surface area per unit weight.

DETAILED DESCRIPTION OF THE PREFERRED EMBODIMENT

The present disclosure utilizes carbon fibers which are substantially pure carbon. The fibers range in length from a minimum of about 10 microns up to about 13 mm and typically have a diameter of about 0.01 mm and less. These fibers are nonconductive, inert, carbon fibers. They are formed by the methods set forth in still pending patent application Ser. No. 700,231 filed Feb. 11, 1985. The unmodified fibers have a substantial surface area, typically at least 400 and up to about 600 square meters per gram. The resiliency of the fibers is sufficient to enable handling for this process. The percent elongation which in part is related to resiliency is in the range of about 1 or 2 percent although greater resiliency is accepted. There is no particular gain with resiliency beyond the level required to enable handling in the fabrication process to be described. This infers that the fibers are substantially resilient as opposed to brittle and thereby suggests easy handling, thereby avoiding breaking of the fibers in small pieces.

The carbon fibers are substantially inert to acid and alkali; the fibers are annealed and are substantially unaltered by exposure to heat up to some desired level, perhaps 500° C. at a minimum or even up to about 1000° C. Preferably, the fibers are classified so that length, diameter and surface area fall within designated ranges as exemplified above. The fibers can be mixed so that the lengths vary in some distribution and it is desirable that a significant portion of the fibers approach the upper length. There is no precise upper limit on length because the fibers are to be used in a felting process to be described. Quite often, the membrane to be fabricated for the electrolysis cell is extremely large in surface area, perhaps measuring several meters in two dimensions. With this observation, an optimum range of lengths would seem to be from about 100 microns at the minimum up to about 0.6 cm. The selection of fiber length depends on physical requirements for the membrane. In part, this relates to the thickness of the membrane as well as the density (or weight) of the completed membrane.

Perhaps an example will set forth the present membrane construction. A blend of 15 grams of fibers of a nominal ¼ inch or 0.6 cm length was mixed with 15 grams of similar fibers of about ⅛ inch or 0.3 cm length. The fibers were mixed with two liters of water and three grams of a fluoropolymer was added to the mixture along with a trace of surfactant. Typically, about 0.2 or 0.4 grams surfactant would suffice. After thorough mixing, the water slurry was vacuum deposited on an 8 inch by 8 inch (or about 20 by 20 cm) screen surface. Water was removed by heating the deposited material. The material was heated to the melting or sinter point of the fluoropolymer. This upper limit for the heating step was determined primarily by the melting point of the fluoropolymer. Thus, the temperature for optimum sintering is in part dependent upon the particular fluoropolymer chosen. After heating for an adequate interval to achieve sintering, the completed membrane can be removed from the supportive surface and used as a membrane in an electrolysis cell.

Ideally, the fluoropolymer should be sufficiently over one percent to provide adequate binding to the carbon fibers. A typical range of fluoropolymer concentration is about one percent to about 20 percent of diaphragm weight. In the foregoing example, the fluoropolymer was 3 grams in contrast to 30 grams of fibers. While the range of about one percent to about 20 percent is permissible, it would seem that the optimal range is about 10 to about 15 percent.

The completed diaphragm weight can vary in a range. The optimum weight seems to be about 0.4 to about 0.5 grams per square inch or just under about 0.1 gm per square cm. This can be increased up to a maximum of about 2.0 grams per square inch or about 0.3 gm/cm$^2$. It would appear however, that a reasonable upper limit is about 1.5 grams per square inch (or about 0.23 gm/cm$^2$). This is particularly useful where the beginning carbon fibers have a surface area of about 600 square meters per gram. The surfactant enables wetting of the fibers during the manufacturing process.

Suitable fluoropolymers include Kynar TM, TFE Teflon TM and also chlorinated TFE, and polychlorinated TFE. The particular fluoropolymer selected should be one which is resistant to the acids or bases involved in the electrolysis cell. For the chlor-alkali process, this includes sodium hypochlorite and caustic, and the fluorocarbon is therefore selected to provide the necessary chemical resistant feature as well as a specified maximum temperature. Regarding the temperature criteria, this depends on the temperature to be sustained in the electrolysis cell.

While the foregoing is directed to the method of manufacture and the product obtained thereby, the scope of the present disclosure is determined by the claims which follow.

What is claimed is:

1. A membrane for use in an electrochemical cell which the membrane is exposed to acid or base materials, the membrane consisting essentially of a felt of carbon fibers which are substantially electrically insulative having various lengths including fibers of up to about 13 mm long and a diameter of up to about 0.01 mm, said fibers bonded with fluoropolymer wherein the weight of the fluoropolymer is up to about 20 percent wherein the fluoropolymer serves as a binding agent securing the carbon fibers in a porous felt sheet having a specified weight.

2. The membrane of claim 1 wherein the fibers have a surface area of about 600 m$^2$/gm.

3. The membrane of claim 1 wherein the fibers have a surface area of about 400 m$^2$/gm and greater.

4. The membrane of claim 1 wherein the fibers have random lengths at least about 10 microns long and the membrane weight is up to about 0.23 gm/cm$^2$.

5. The membrane of claim 4 wherein the fibers are nonbrittle to enable handling.

6. The membrane of claim 1 wherein the fibers are chemically resistant, are pliable and bendable and have at least one percent elongation and are mixed length fibers in a random felting of fibers and are also adhesively bonded by the fluoropolymer, being at least about 10 percent by weight of fluoropolymer.

7. The membrane of claim 1 wherein the fluoropolymer is between about 10 and about 15 percent by weight and is sintered in the membrane.

8. The membrane of claim 1 wherein the fibers are annealed and are heat resistant to temperatures up to about 1000° C.

9. A method of forming a membrane for use in an electrolysis cell to divide the cell into two compartments, the method comprising the steps of:

(a) making a slurry of a disposable solvent, a fluoropolymer binder, surfactant and carbon fibers, the carbon fibers being characterized by having a surface area per unit weight at least about 400 m$^2$/gm, being electrically nonconductive and resistant to chemical attack by the chemicals in the electrolysis cell;

(b) pouring the slurry on a supportive surface to form a layer thereon;

(c) drying the slurry to form a felted membrane having carbon fibers in a felted pattern; and (d) heating the material to a temperature sufficient to achieve sintering of the fluoropolymer to bind the carbon fibers in the felted pattern.

10. The method of claim 9 including the step of removing the solvent by vacuum and heat.

11. The method of claim 9 including the step of mixing the fibers randomly between the lengths of at least about 10 microns and up to about 13 mm.

12. The method of claim 9 including the step of grinding the membrane after use to depletion.

* * * * *